US009498398B1

(12) United States Patent
Ehrenleitner

(10) Patent No.: US 9,498,398 B1
(45) Date of Patent: Nov. 22, 2016

(54) MASSAGE CHAIR AND TABLE

(71) Applicant: EB-invent GmbH, Altensteig-Walddorf (DE)

(72) Inventor: Franz Ehrenleitner, Altensteig-Walddorf (DE)

(73) Assignee: EB-INVENT GMBH (DE)

( * ) Notice: Subject to any disclaimer, the term of this patent is extended or adjusted under 35 U.S.C. 154(b) by 0 days.

(21) Appl. No.: 14/805,896

(22) Filed: Jul. 22, 2015

(51) Int. Cl.

| | |
|---|---|
| ***A47C 7/50*** | (2006.01) |
| ***A47C 13/00*** | (2006.01) |
| ***A61G 15/02*** | (2006.01) |
| ***A47C 7/58*** | (2006.01) |
| ***A47C 3/18*** | (2006.01) |

(52) U.S. Cl.
CPC ..... *A61G 15/02* (2013.01); *A47C 3/18* (2013.01); *A47C 7/58* (2013.01)

(58) Field of Classification Search
CPC ..... A61G 15/02; A47C 7/58; A47C 3/18
USPC ..... 297/118, 354.13, 423.11, 423.12, 900
See application file for complete search history.

(56) References Cited

U.S. PATENT DOCUMENTS 5,401,078 A * 3/1995 Riach ..... A47C 7/503 297/423.11 X
5,762,402 A * 6/1998 Gillotti ..... A61G 15/007 297/423.11 X
5,971,485 A * 10/1999 Clark ..... A61G 13/009 297/423.11 X
6,065,808 A * 5/2000 Tinsley ..... A47C 9/005 297/423.11 X
6,276,012 B2 * 8/2001 Borders ..... 5/622
6,397,414 B1 * 6/2002 Lloyd ..... A47C 20/026 297/900
6,543,853 B1 * 4/2003 Splane, Jr. ..... A61G 15/007 297/423.11 X
6,769,736 B2 * 8/2004 Roleder ..... A47C 9/005 297/423.12 X
2002/0067060 A1 * 6/2002 Lloyd ..... A47C 9/005 297/423.11 X
2002/0096929 A1 * 7/2002 Showerman ..... A47C 7/38 297/423.12
2002/0101108 A1 * 8/2002 Roleder ..... A47C 9/005 297/423.12
2002/0171281 A1 * 11/2002 Cochran ..... A61G 15/007 297/423.11
2004/0070253 A1 * 4/2004 Murphy ..... A61G 15/00 297/423.11
2005/0035644 A1 * 2/2005 Lloyd ..... A47C 9/005 297/423.11

* cited by examiner

*Primary Examiner* — Rodney B White
(74) *Attorney, Agent, or Firm* — Kolisch Hartwell, P.C.

(57) ABSTRACT

A massage couch or a massage chair having a supporting part resting on the subsurface and a pivoting part mounted thereon such that it can pivot about a horizontal axis of rotation and on which the person to be massaged sits or lies, characterized in that the axis of rotation is located higher than the supporting part. The ability of the pivoting part to pivot with respect to the supporting part is preferably achieved by means of at least one kinematic device, which comprises an articulated parallelogram on the supporting part and an articulated parallelogram on the pivoting part.

8 Claims, 7 Drawing Sheets

MASSAGE CHAIR AND TABLE

Figure 2:
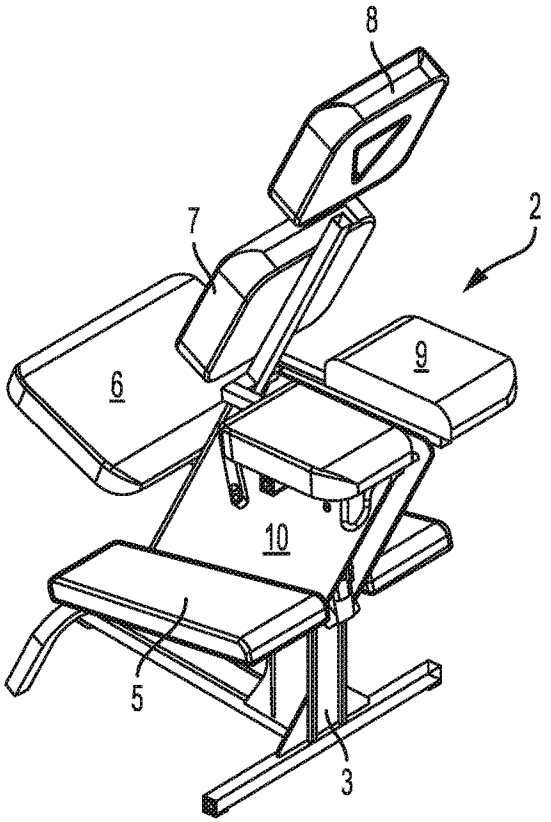

The invention relates to a massage couch or a massage chair. Such structures, on which the person to be massaged lies or crouches or sits bending forward, are variously known in the prior art. However, there is no couch which can be converted into a chair and no chair which can truly be brought into a configuration of its adjustable parts in which the person to be massaged assumes an at least approximately lying posture. Furthermore, it is not possible at all to make changes in the configuration when a person has occupied the chair or the couch. Then, only more relatively slight adjustments of the position, for example the armrest or the supporting surface for the head, are possible.

Since, during massaging, depending on the part of the body to be massaged, a different position of the person to be massaged would be beneficial to the masseur but, for reasons of relaxation and treatment, the person to be massaged is not intended to stand up during the massage, the masseur is forced to perform a whole series of massage steps in a bodily position which is very uncomfortable for him. It would also be advantageous for the person to be massaged to be able to assume an adapted posture, depending on the type of massage.

For a long time, there has been a desire of the masseurs, the healing centers, hospitals and also those persons massaged, to have a massage chair available which can be converted into a massage couch while a person to be massaged is on the same.

The object of the invention is to devise such a massage chair.

According to the invention, this is achieved in that the massage chair has a lower part, resting on the floor, on which a pivoting part is fixed such that it can pivot about a horizontal axis, wherein the horizontal axis is located above the supporting part. As a result, the pivot axis comes into the region of the center of gravity of the combination of user plus pivoting part, and this means that pivoting is possible even with the person who is to be massaged on the chair or the couch; according to the invention there is no longer any difference, since high moments or off-center forces no longer occur.

In order to achieve this position of the axis of rotation, a kinematic mechanism formed from a plurality of rods connected to each other in an articulated manner is provided, for example between the supporting part and the pivoting part. This kinematic mechanism is substantially constructed in the following way:

On the lower part, also called the supporting part, two rods are rotatably mounted, the free ends of which are rotatably connected to a common coupler and which thus form an articulated parallelogram. One of the two rods, in the usual position of the massage couch it is the lower, projects further forward beyond the joint at which the coupler is connected thereto.

On the pivoting part, a kinematic mechanical structure that is analogous thereto is provided; here too, two rods which are attached in an articulated manner to the pivoting part and a coupler assigned thereto form an articulated parallelogram. In this articulated parallelogram, too, the lower rod is extended further beyond the attachment point of its coupler.

These two partial kinematic mechanisms are now linked to each other in the following way: the two longer, lower rods are pivotably connected to each other at their ends, and the two shorter (upper) rods are connected in alignment and movably to each other by the axes with which they are connected to each other by their respective coupler. To this end, according to the invention the articulated parallelograms are designed with their lengths such that the extension of the axial connections on the supporting part and the extension of the axial connections on the pivoting part intersect at one and the same point as the extension of the connection of the axes of the rod ends. This threefold point of intersection then forms the axis of rotation of the pivoting part around the supporting part, even though there is no component at this point, a virtual pivot axis is created.

By means of appropriate selection of the arrangement of the rod axes on the supporting part and on the pivoting part, this virtual pivot axis is placed in such a geometric region that the latter is located as close as possible to the center of gravity of the combination of person to be massaged plus pivoting part. Of course, because of the different physicalities (mass and stature) of the persons to be massaged, this can be done only approximately but it is nevertheless possible for the chair or the couch also to be adjusted to a great extent without the person to be massaged having to dismount.

Figure 9:
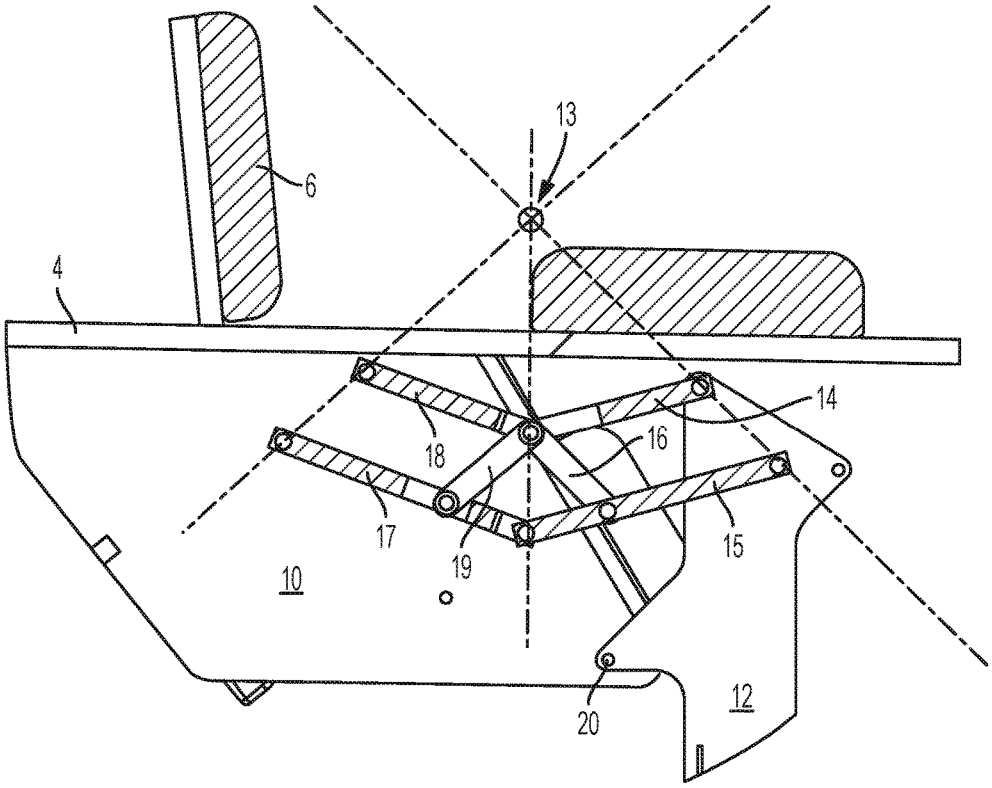
Figure 10:
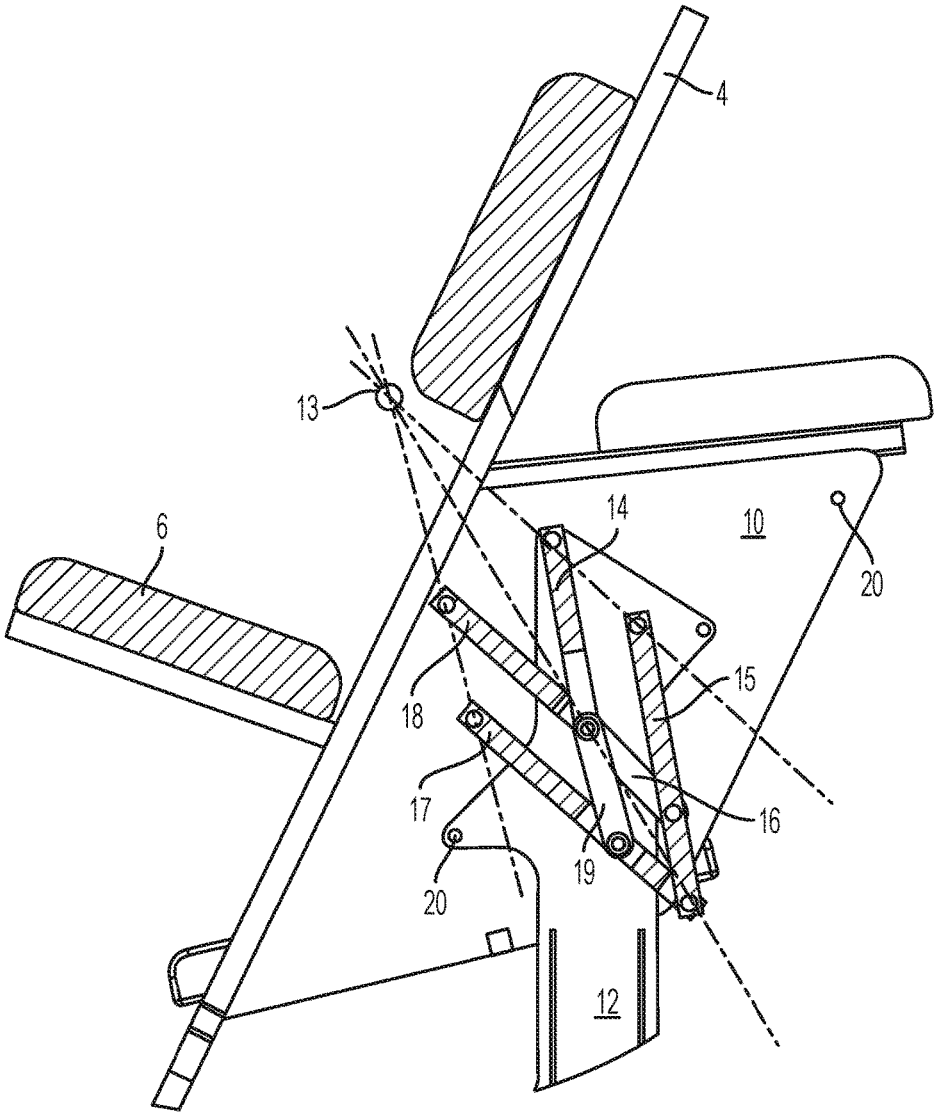
Figure 11:
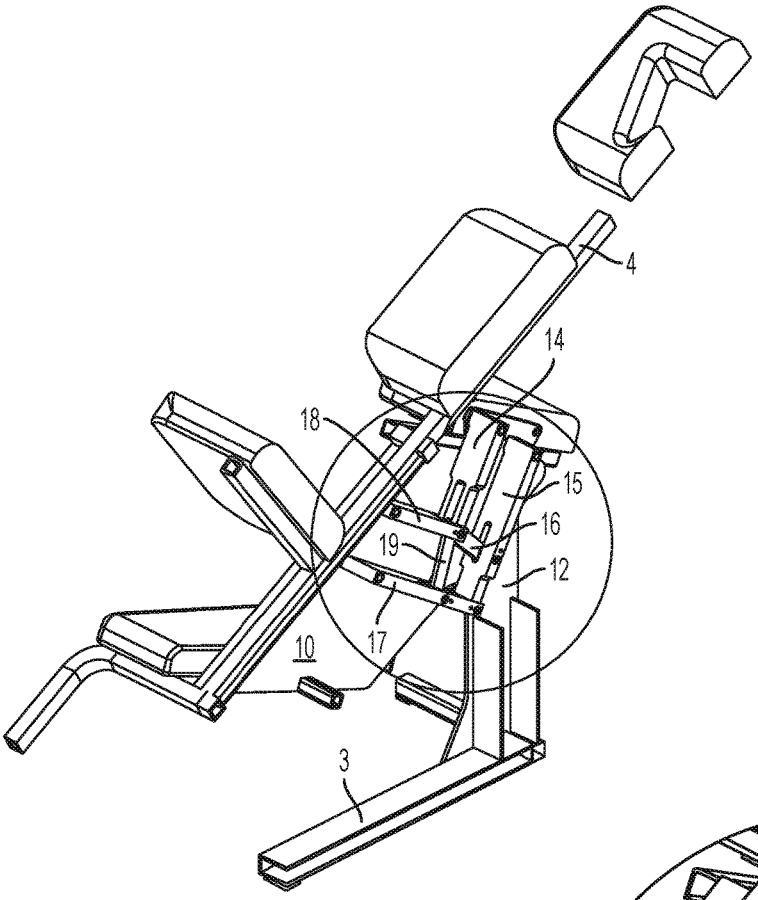
Figure 12:
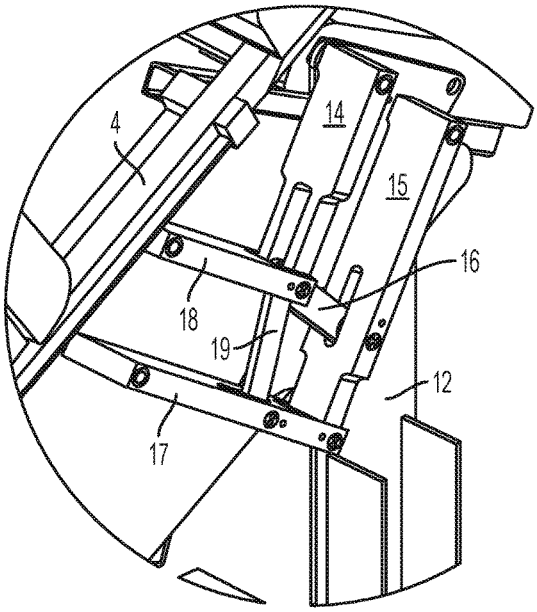

The invention will be explained in more detail below by using the drawing, in which:

FIGS. 1 to 4 show a massage couch according to the invention in the sitting position in a perspective view and in a side view and in a schematic section, partly with, partly without a person to be massaged, FIGS. 5 to 8 show illustrations corresponding to those of FIGS. 1 to 4 but in the lying position, FIGS. 9 and 10 show details with the kinematic device, and FIGS. 11 and 12 show an oblique view, partly sectioned, and an enlarged detail.

Figure 1:
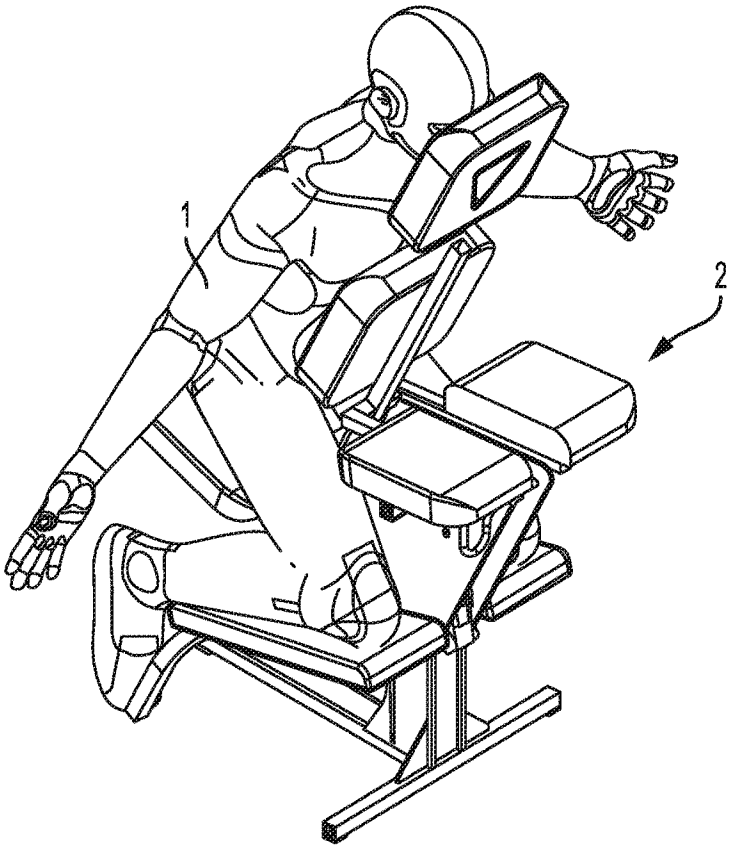

FIG. 1 shows a user 1 on a massage chair 2. In this illustration, the massage chair 2 is in the configuration in which the user 1 assumes a crouching or kneeling position thereon, as is beneficial for various types of massage.

FIG. 2 shows the massage chair 2 without user and permits the individual parts to be seen better. A supporting part 3 rests on the floor and is pivotably connected to a kinematic device, which cannot be seen in FIG. 2, having a pivoting part 4. In the exemplary embodiment illustrated, the pivoting part 4 has, at least substantially symmetrically with respect to a mid-plane which coincides adequately with the plane of symmetry of the presumed user, knee supports 5, a sitting area 6, a breast support 7, a headrest 8 and arm supports 9. These parts are fixed suitably to two parallel and aligned supporting plates 10 of the pivoting part 4 that are connected to each other. The two supporting plates 10 have a sufficient distance between the mutually facing surfaces in order to accommodate the kinematic device designated overall by 11 (FIG. 4).

In the exemplary embodiment illustrated, the supporting part 3 has a supporting structure 12 projecting upward, which is preferably designed to be plate-like or at least thin transversely with respect to the paper plane (drawing plane) and, on both sides of the supporting structure 12, carries a kinematic mechanism 11 each. In turn outside thereof, there is one each of the supporting plates 10 of the pivoting part 4, so that the kinematic mechanisms 11 are covered in such a way that no unauthorized persons can reach them and thus any risk of injury (pinching) is banned. Of course, other arrangements can be made, in particular only one kinematic mechanism 11 can be provided, which then has to be constructed appropriately solidly.

Figure 4:
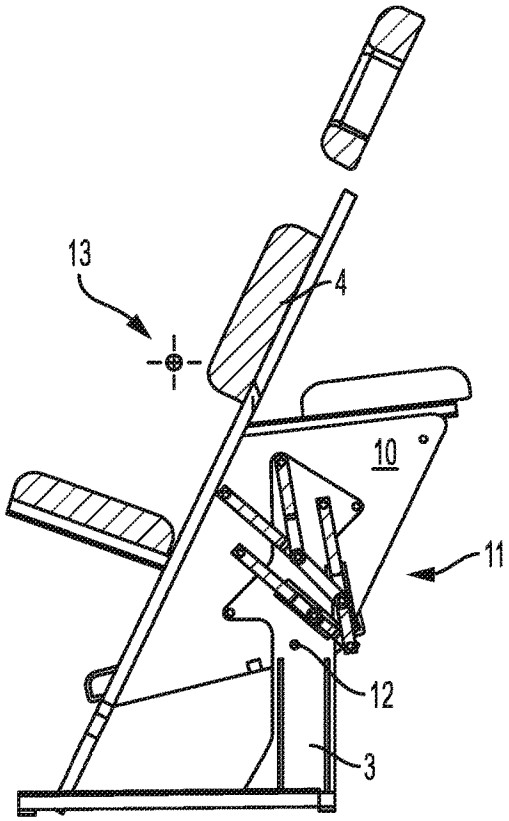

The kinematic mechanism 11 is illustrated in FIG. 4, likewise the axis of rotation 13 of the pivoting part 4 about the supporting part 3 which, as can clearly be seen, is located noticeably above the kinematic mechanism 11.

Figure 3:
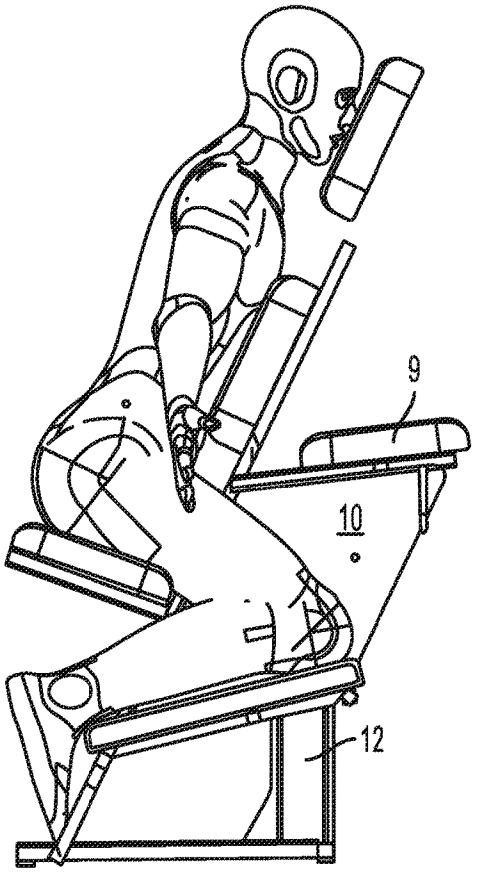
Figure 6:
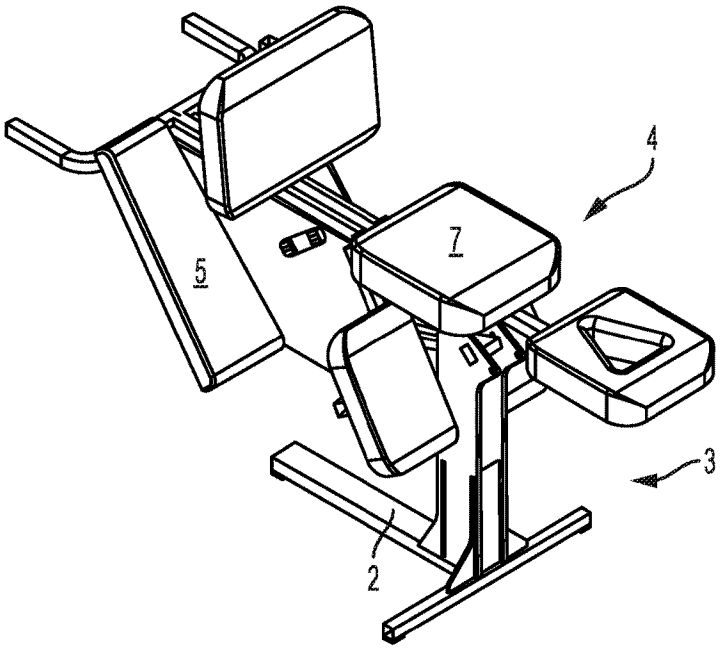
Figure 5:
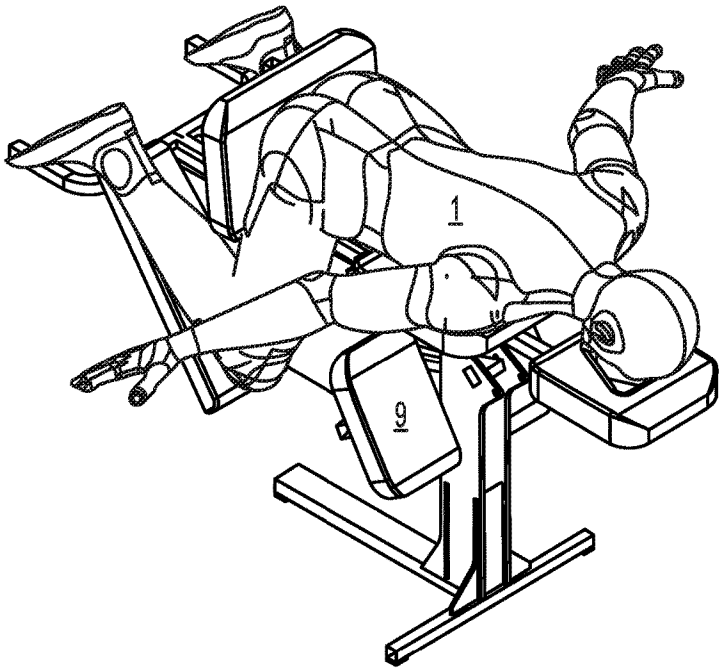
Figure 8:
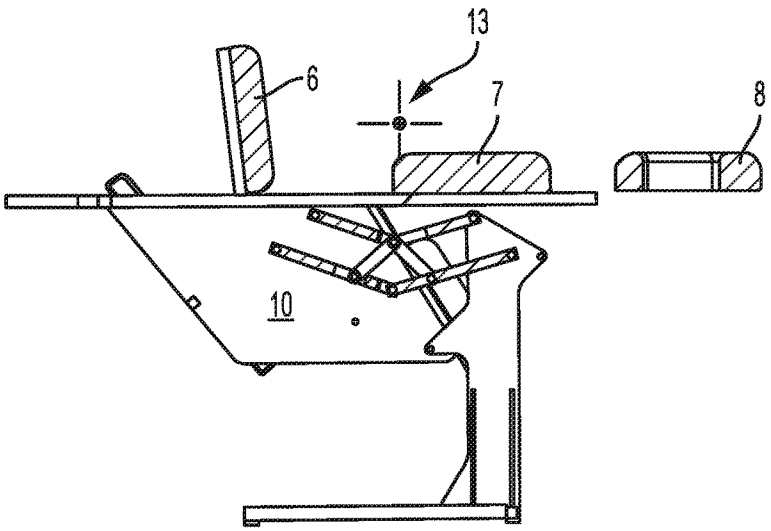
Figure 7:
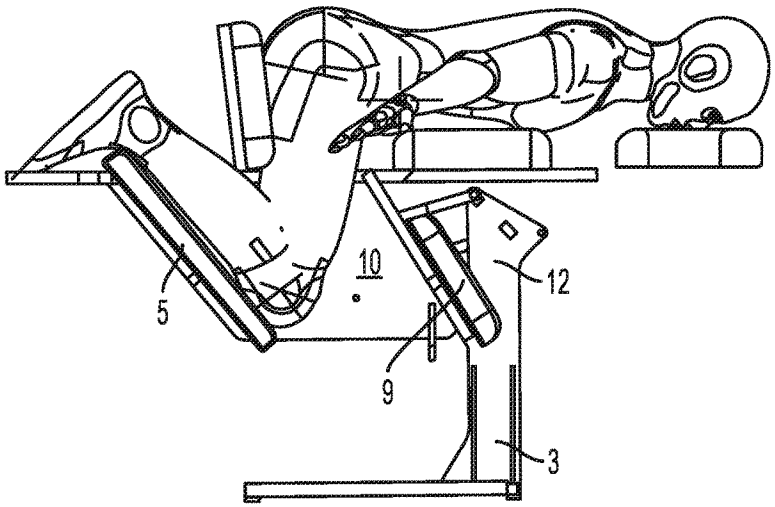

As can be seen from a comparison of FIG. 3 with FIG. 4, the axis of rotation 13 is located approximately in the region of the upper pelvis of the user when he is resting on the massage chair 2, and this corresponds approximately to the center of gravity of the whole mass to be moved, comprising the user 1 and the pivoting part 4. As compared therewith, the components of the kinematic mechanism 11 sometimes to be included play no part at all.

The mobility of the massage chair 2 according to the invention emerges from a comparison of FIGS. 1 to 4 with the same views of FIGS. 5 to 8, FIGS. 5 to 8 respectively illustrating the situation in the entirely horizontal state of the massage chair 2, in which it thus corresponds to a massage bench or massage couch. Here, the same parts are provided with the same designations as in FIGS. 1 to 4.

FIGS. 9 and 10 show a kinematic mechanism 11 according to the invention in the sitting position and in the lying position on an enlarged scale; this is also illustrated well perspectively in FIG. 12. Two supporting rods 14 and 15 are attached in an articulated manner to the supporting part 12. The two pivots or axes of rotation on the supporting part 12 form a "sighting line" (this is all drawn dash-dotted and does not bear any designation) toward the axis of rotation 13. As already explained at the start, the two rods 14 and 15 are connected to each other by means of a coupler 16 such that they form an articulated parallelogram. The lower of the two rods, the rod 15, is formed so as to go beyond the joint of the coupler 16.

Now, likewise attached to the supporting plate 10, are two rods, called pivoting rods, of which the pivots on the supporting plates 10 likewise form a sighting line toward the axis of rotation 13, since the kinematic mechanism 11 has the following properties named below: the lower pivoting rod 17 projects beyond the attachment point of its coupler 19, in a manner analogous to the lower supporting rod 15 on the side of the supporting part 12.

The rods of the kinematic mechanism 11 are connected in the following way: the upper, shorter rods 14, 18 together with the couplers 16, 19, have a common axis of rotation, the outermost ends of the lower, longer rods 15, 17 jointly have an axis of rotation. These two axes form a sighting line, which is likewise directed toward the axis of rotation 13.

The comparison between FIGS. 9 and 10 shows the functioning of this kinematic mechanism which, in the exemplary embodiment illustrated, is provided twice, specifically on both sides of the plane of symmetry of the device (drawing plane), in each case between the outer sides of the supporting part 12 and the inner sides of the two supporting plates 10. In this way, the necessary mechanical stability and safety is achieved and, as already mentioned, shielding of the kinematic mechanism against unauthorized contact (or playing around) with the corresponding risk of pinching is also created.

Also to be seen from the figures is a fixing device for fixing the pivoting part 4 in its lying position; this is an opening 20 in the pivoting part 10 which is aligned with an opening 20' in the supporting part 12 when the lying position (FIG. 10) is reached and can then be secured in this position by a split pin or the like.

The invention can be modified and configured in many ways; for example all of the supporting surfaces can be constructed differently than as illustrated and they can of course be fixed adjustably to the supporting plate 10 in order to permit comfortable use to the same extent for various body sizes. In this respect, merely as an example, reference should be made to FIG. 7 where, by means of a pivotable arrangement of the knee supports 5, a more comfortable body posture can be achieved as illustrated; the arm supports 9 can also be adapted appropriately. However, this does not have much to do with the invention and, moreover, is also known in massage chairs and massage couches such as are known from the prior art.

LIST OF DESIGNATIONS

1 User
2 Massage chair
3 Supporting part
4 Pivoting part
5 Knee supports
6 Sitting area
7 Breast support
8 Headrest
9 Arm supports
10 Supporting plates
11 Kinematic mechanism
12 Supporting structure
13 Axis of rotation
14 Upper supporting rod
15 Lower supporting rod
16 Coupler
17 Lower pivoting rod
18 Upper pivoting rod
19 Coupler
20 Opening
20' Opening

The invention claimed is:

1. A massage chair that can be converted into a massage couch, comprising:

a supporting base;

a pivoting portion mounted to the supporting base, where the pivoting portion is configured to support a person to be massaged and is configured to pivot around a horizontal axis of rotation from a first sitting position to a second lying position; and at least one kinematic device connecting the pivoting portion to the supporting base, the at least one kinematic device including an upper supporting rod and a lower supporting rod that are each attached in an articulated manner to the supporting base and connected to each other by a first coupler to form a first articulated parallelogram; and an upper pivoting rod and a lower pivoting rod that are each attached in an articulated manner to the pivoting portion and connected to each other by a second coupler to form a second articulated parallelogram;

wherein the first articulated parallelogram is coupled to the second articulated parallelogram, and the at least one kinematic device is configured so that pivoting the pivoting portion around the horizontal axis of rotation also pivots the pivoting portion with respect to the supporting base; and wherein the horizontal axis of rotation is higher than the supporting base.

2. The massage chair of claim 1, wherein as the pivoting portion is pivoted around the horizontal axis of rotation from the first sitting position to the second lying position, the massage chair is converted into a massage couch.

3. The massage chair of claim 1, wherein the pivoting portion is configured to support the person to be massaged before, during, and after the pivoting portion is pivoted.

4. The massage chair of claim 1, wherein the horizontal axis of rotation is located in the region of a pelvis of the person to be massaged when they are supported by the pivoting portion.

5. The massage chair of claim 1, wherein an end of the lower supporting rod extends beyond an attachment point of the first coupler, and an end of the lower pivoting rod extends beyond an attachment point of the second coupler, and the end of the lower supporting rod is connected to the end of the lower pivoting rod in an articulated manner; and an end of the upper supporting rod, an end of the upper pivoting rod, and the first and second couplers are all pivotally coupled at a common axis of rotation.

6. The massage chair of claim 5, wherein the attachment points of the upper and lower supporting rods on the supporting base define a first sight line, the attachment points of the upper and lower pivoting rods on the pivoting portion define a second sight line, and the connection points of the upper supporting rod with the upper pivoting rod and the lower supporting rod with the lower pivoting rod, respectively, define a third sight line; and wherein the first sighting line, the second sighting line, and the third sighting line intersect at a common point that is substantially coincident with the horizontal axis of rotation.

7. The massage chair of claim 1, wherein the pivoting portion further comprises a pair of supporting plates that shield the at least one kinematic device.

8. The massage chair of claim 7, wherein each upper pivoting rod and each lower pivoting rod is attached to the pivoting portion at one of the supporting plates.

* * * * *